United States Patent [19]

Ohtake

[11] 4,075,762

[45] Feb. 28, 1978

[54] INSTRUMENT FOR MAKING PERSPECTIVE DRAWING

[76] Inventor: Kazuomi Ohtake, 6-13, 2 chome, Tenjincho, Fuchu, Tokyo, Japan

[21] Appl. No.: 727,340

[22] Filed: Sep. 28, 1976

[30] Foreign Application Priority Data

Oct. 1, 1975 Japan ..... 50-119171

[51] Int. Cl.[2] ..... B43L 13/14

[52] U.S. Cl. ..... 33/77

[58] Field of Search ..... 33/76 R, 77, 79 R

[56] References Cited

U.S. PATENT DOCUMENTS

| | | | |
|---|---|---|---|
| 1,794,648 | 3/1931 | Shattow | 33/79 R |
| 1,807,237 | 5/1931 | DePostels | 33/77 |
| 2,874,474 | 2/1959 | Beebe et al. | 33/76 |
| 3,332,152 | 7/1967 | Dru | 33/77 |
| 3,441,322 | 4/1969 | Leschinger | 33/76 |
| 3,718,975 | 3/1973 | Ross | 33/77 |

FOREIGN PATENT DOCUMENTS

| | | | |
|---|---|---|---|
| 413,337 | 4/1946 | Italy | 33/77 |

*Primary Examiner*—Richard E. Aegerter
*Assistant Examiner*—John W. Shepperd
*Attorney, Agent, or Firm*—Burns, Doane, Swecker & Mathis

[57] ABSTRACT

An instrument adapted for making perspective drawing, comprising a slider on a base plate and a link pivoted to two levers of exactly equal lengths between pivot centers and at equal distances on the slider and the link. The arrangement further includes a ruler or bar extending in a direction generally transversely to the levers and connected thereto by means of a joint structure which is slidable along the levers to any desired set position and which permits a rotational as well as a sliding motion of the ruler relative to the joint center as the angular position of the ruler relative to the levers is changed.

3 Claims, 9 Drawing Figures

INSTRUMENT FOR MAKING PERSPECTIVE DRAWING

BACKGROUND OF THE INVENTION

This invention relates to an instrument for making perspective drawing and more particularly to the lever and link arrangements adapted to have each set of parallel lines of objects come together automatically on the picture at their own vanishing point no matter how far apart that point may locate from or even though the point is clear off the drawing board.

It has heretofore been known in perspective drawing that frequently one or more vanishing points are found to be completely off the drawing board. In FIG. 1*b*, although a left vanishing point V1 is located on the drawing board DB, the other vanishing point V2 is outside of the drawing board. Further, in FIG. 1*c*, three vanishing points are all clear off the drawing board DB so that none of them may be indicated in th Figure. In FIG. 1*a*, although a single vanishing point V is within the same drawing board DB, that situation is usually lesser presented.

In such situations as shown in FIGS. 1*b* and 1*c*, a pin and a very long ruler or bar and the like are required in order to produce various lines exactly coming together at their own vanishing point outside of the drawing board. The pin is located at the outside vanishing point and the long ruler or bar is used in order to move the pencil therealong exactly toward the pin, for obtaining a correct perspective of box B.

While various means have been provided for making perspective drawing without using the long ruler and the pin, none has proven to be entirely sufficient.

SUMMARY OF THE INVENTION

A principal object of the invention is to provide an improved instrument for making perspective drawing of this character which is capable of having a set of parallel lines of objects go to the same vanishing point automatically without any obstructions by parts of that instrument located ahead of the pencil producing the picture.

And further, the instrument is characterized by provision of means which assure smooth operation without rattle when the levers are swung.

For the foregoing object and others, the lever and link arrangement is characterized essentially in that it comprises a slider on a base plate and a link pivoted to two always parallel levers of exactly equal lengths between pivot centers and at equal distances apart on the slider and the link. The arrangement further includes a ruler or bar extending in a direction generally transversely to the levers and being connected thereto through means of a joint structure which is slidable along the levers to any desired set position and which permits a rotational as well as a sliding motion of the ruler relative to the joint centre as the angular position of the ruler relative to the levers is changed.

With the instrument according to the invention, any possibility of obstacles offered by the levers ahead of the pencil on its path, is avoided by beforehand so displacing the slider on the base plate that the levers are located outside of a range on the drawing board within which is produced the picture.

DESCRIPTION OF THE PREFERRED EMBODIMENT

Figure 1A:
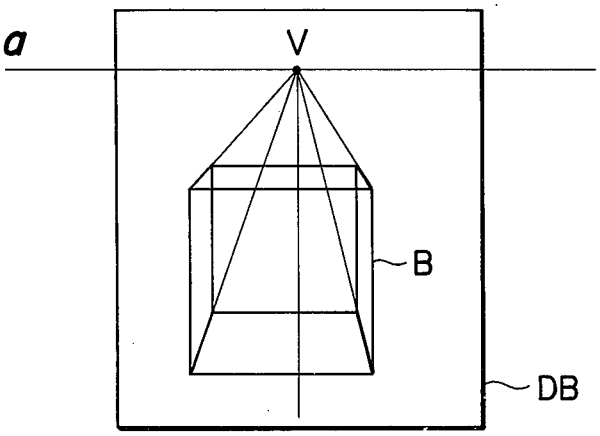
FIGS. 1*a* to 1*c* are views showing vanishing points used in making various perspective drawings.
Figure 1B:
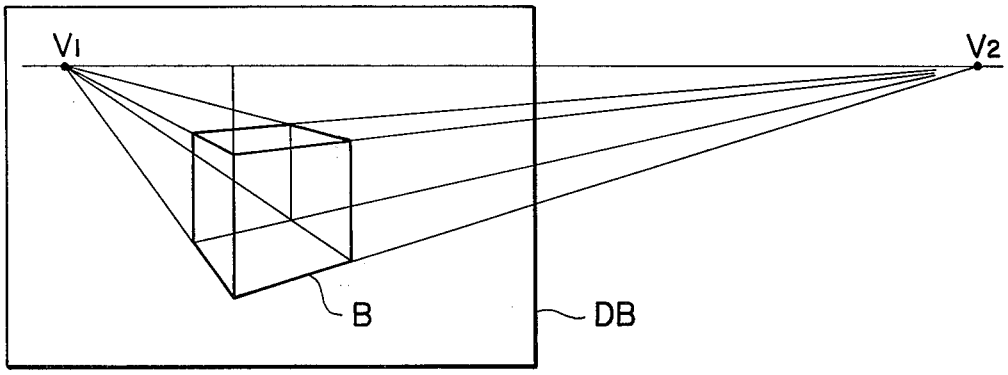
Figure 1C:
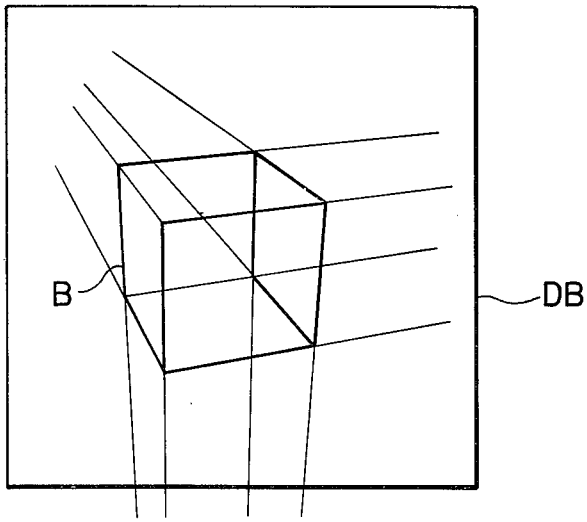
Figure 2A:
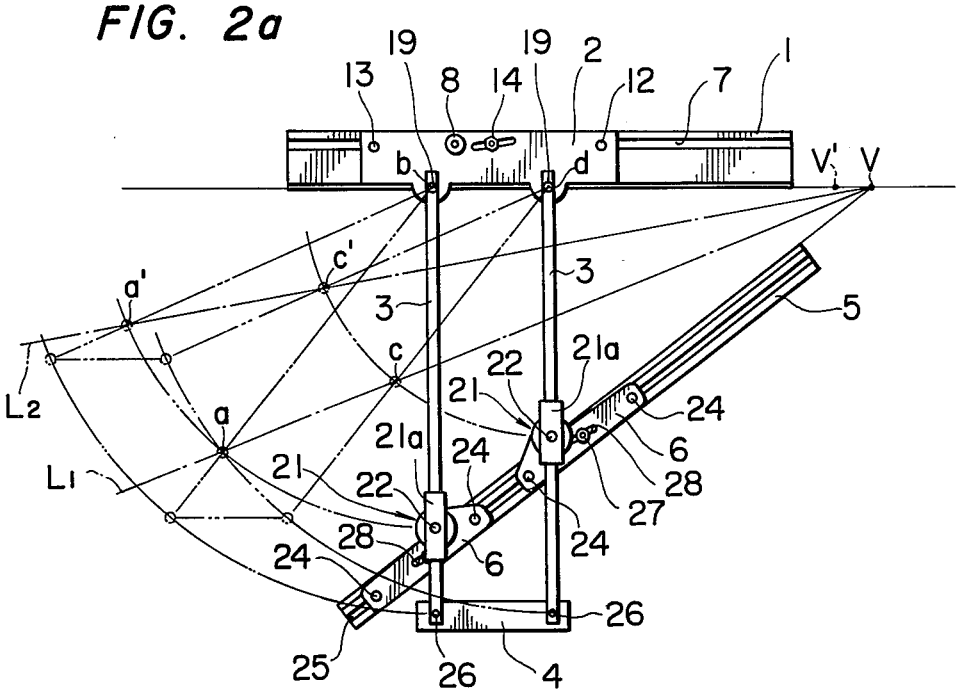
FIG. 2*a* is a plan view of the instrument according to the invention.
Figure 2B:
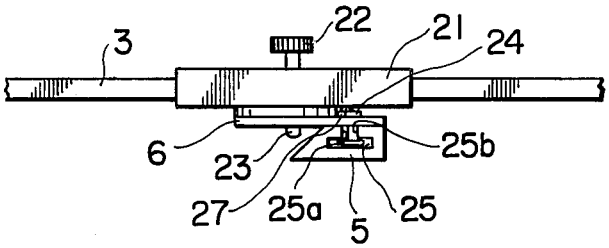
FIG. 2*b* is a side view partially showing the instrument of FIG. 2*a* in enlarged scale.

Now referring to FIGS. 2*a* and 2*b* a sliding member 2 which is merely referred to as a slider is arranged for a longitudinally sliding fit on a base plate 1. The slider 2 and a connecting link 4 are pivoted at 19 and 26 respectively to two levers 3 of exactly equal lengths between pivot centres and at equal distances on the slider 2 and link 4 so that parallelogram lever and link arrangement is formed. The slider 2 has a clamping screw 8 and three shoe members 12 to 14 in order to provide a slidable and rattle preventing connection of the slider with the base plate 1 as will be explained as the discussion proceeds.

Figure 3:
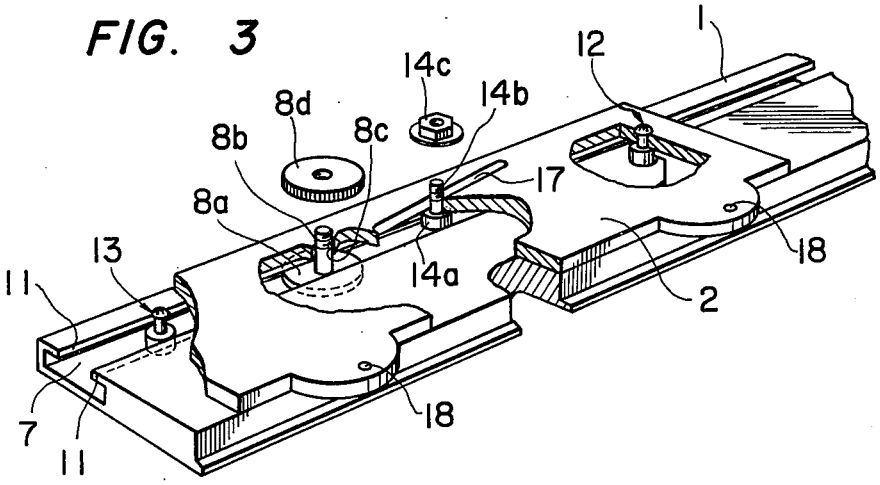
FIG. 3 is a perspective view of the instrument partially cut off.
Figure 4:
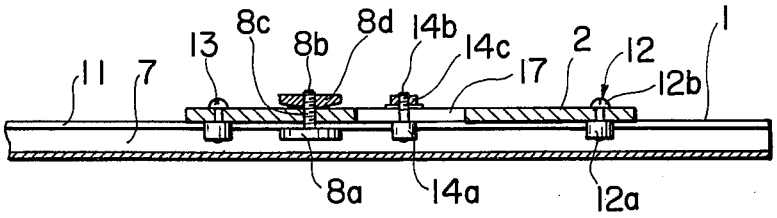
FIG. 4 is an axial sectional view taken along the line IV—IV in FIG. 5.

As shown in FIG. 3 in enlarged scale, the outer shoes 12 and 13 are structurally identical with each other and therefore only shoe 12 will be described herein. The shoe 12 has a bottom head 12*a* and top head 12*b* as seen in FIG. 4. Between th two heads is firmly clamped the wall of the slider 2. The middle shoe 14 is of slightly different structure and has a hexagon head 14*c* to be screwed to the threaded stem 14*b* which protrudes beyond the slider 2 upward through an inclined slot 17. The slot 17 is inclined at an angle to an imaginary line on which lie the two outer shoes 12 and 13. By varying location in the slot 17 the distance of shoe 14 to the imaginary line is variable so that better suiting of the three shoes is provided to the longitudinal clearance formed between the edges 11 of slot 7. The selected location of the shoe 14 is ensured by tightening the hexagon head 14*c* and the stem 14*b*. The clamping screw 8 has a bottom head 8*a* of large diametrical size sufficient to extend over the two parallel edges 11. A threaded stem 8*b* protrudes upwardly beyond the wall of the slider 2 through a hole 8*c* therein. At the revealed top end of the stem 8*b* is screwed a knurled nut 8*d*. As will be seen in FIG. 3, the bottom head 8*a* is in slidable and nested engagement with the T-shaped slot 7 when the nut 8*d* is backed off. The slider 2 is prevented from falling off from the base plate 1 by virtue of the larger diametrical size of the bottom head 8*a* than the width of clearance between the edges 11. By screwing down the knurled nut 8*d* the slider 2 and the base plate 1 are tightened together and they are slidable relative to each other by releasing the knurled nut in order to suit the required loational condition. A pair of spaced small holes 18 on the forward edge of the slider 2 are provided for pivoting the parallel levers 3 by means of pins 19 to be inserted therethrough.

Referring back to FIGS. 2*a* and 2*b*, both levers 3 have joints generally indicated by numeral 21. The joints 21 are structurally identical and hence only one of them is described herein. The joint 21 is formed of a sleeve 21*a* sidable along lever 3 and a bracket 6 pivoted to the sleeve 21*a* at its under side by means of a pin 23. The sleeve 21*a* has a set screw 22 to fasten the member to the lever 3 at any selected position on the lever. The bracket 6 has a pair of outer shoes 24 and a middle shoe 27. The outer shoes 24 are of identical construction and hence only one of them is described herein. The shoe 24 has a bottom head (not shown) slidably nested within a longitudinal T-shaped slot 25 (FIG. 2*b*) in a ruler or bar 5 so that the shoe is prevented from being separated from the ruler 5. The shoe 24 has further a top head (not shown in enlarged scale) which cooperates with the bottom head to slidably clamp the wall of the bracket 6 together with both edges 25*a*, 25*b* of slot 25 so that slidably clamping engagement is provided between the bracket 6 and the ruler 5. The middle shoe 27 has a bottom head and stem at the threaded top of which is screwed the top head somewhat like the usual nut. The shape of the bottom head of the shoe 27 is preferred to be of rectangular form so that the top head may be screwed to or unscrewed from the threaded stem of the shoe 27 with the stem left stationary. The stem of the shoe 27 passes upward through an inclined slot 28 in the bracket 6. The inclination of the slot 28 is provision for adjusting the distance of the stem to a line on which lies the stem of each shoe 24 so that a desirable better slidable fit condition is met by handling the threaded nut like top head of the shoe 27, in the same manner as the middle shoe 14 of the slider 2 described in the foregoing. It should be noted that the bottom head of the middle shoe 27 merely serves to clamp only the wall of the bracket 6 in cooperation with the top head. This is a difference of the middle shoe 27 from the outer shoe 24.

Figure 5:
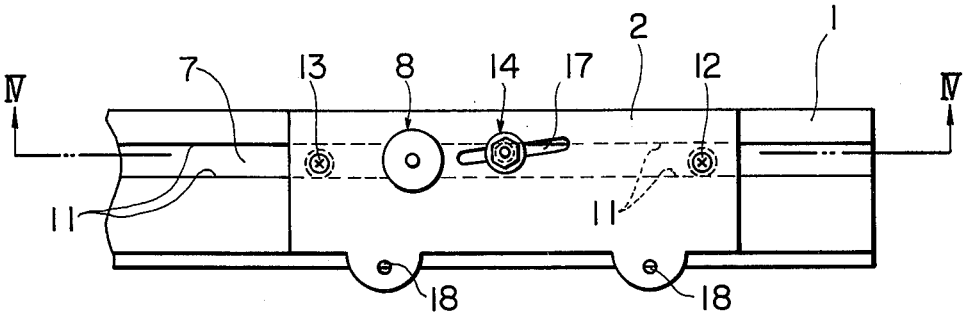
FIG. 5 is a plan view of the base plate and the slider in enlarged scale.

The arrangement of the three shoes 24 and 27 has been thus far described without reference to detailed illustrations because of readiness in understanding the arrangement by virtue of a close resemblance between that arrangement and the other arrangement of shoes 12 to 14 of the slider 2 shown in FIGS. 3 to 5, except that the shoe 12 only clamps the wall of the slider 2 whereas the shoe 24 clamps slidably both the bracket 6 and the edges of the slot 25 in ruler 5.

In actual use, the base plate is first located at an intended position on the drawing board. The ruler 5 is then directed to a desired vanishing point V as shown in FIG. 2*a* under the backed off condition of both set screws 22 of the joints 21. The set screws 22 are tightened so as to fasten the sleeves 21*a* to the levers 3, with the levers 3 kept at any angle selected relative to the slider 2. By moving the pencil along the ruler, an intended line which passes through the vanishing point V is produced as shown in FIG. 2*a*. By rotating the levers 3 about their pivoting pins 19, so as to shift the ruler 5 to the other positions shown in dot-and-dash lines L1 and L2 in FIGS. 2*a*, the other lines L1 and L2 either passing through the same vanishing point V are obtained. When once the sleeves 21*a* are fastened on the levers 3, the ruler 5 serves to guide the pencil to produce lines passing through the vanishing point V as shown in FIG. 2*a*, though the levers are rotated through an angle of any value. This is a significant feature of the instrument according to the invention. Further the most important or essential feature of the instrument establishes that the slider 2 is a sliding fit on the base plate 1 and accordingly the slider 2 is shiftable on the base plate 1 with an intention of locating the levers 3 outside of a range in which the picture is drawn.

Figure 6:
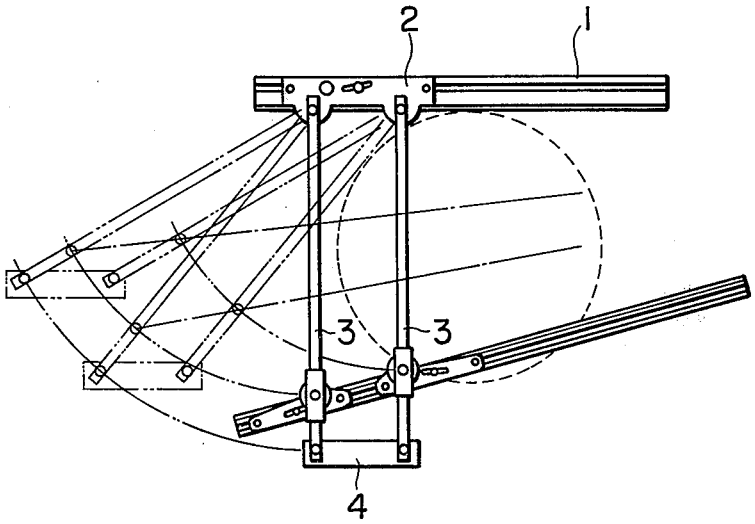
FIG. 6 is a plan view of the instrument in actual use for producing a picture on the drawing board.

In FIG. 6, two lines shown in dot-and-dash line together go to the same vanishing point (not shown) for apart from the range shown by a circle in dotted line. In producing the two lines, the levers 3 either locates outside of the range so that the pencil may readily move along the ruler 5 so as to produce the two lines as shown in dot-and-dash lines without any obstacles ahead of the pencil on its path along the ruler. In case where the other lines are required to be produced leading to another vanishing point such as is located at the upper left in FIG. 6, the slider is first shifted to the right on the base plate 1 generally to a position in symmetrical relation with its former location relative to the center of the dotted line circle, and then the ruler 5 is directed to said another vanishing point at the upper left, with the set screw 22 being manipulated. In the latter case, the levers 3 are also outside of the dotted line circle and no obstacle appears ahead of the pencil on its path in producing the lines along the ruler 5.

As previously described, when once the joints 21 are set fast on their corresponding levers 3, thereafter lines produced by moving the pencil along the ruler 5 will pass through the same vanishing point, of whatever value may be the angle of the inclined levers 3.

This fact is further explained by using formulas in the following manner.

Referring to FIG. 2*a* again, and considering two triangles Vab and Vcd; they are similar by construction; therefore $(X+C)/X = R1/R2$ (where $X$ = distance between points V and *d*, $C$ = distance between points *d* and *b*, $R1$ = distance between points *a* and *b*, and $R2$ = distance between points *c* and *d*) . . . (1)

In considering the other two triangles produced by displacing the ruler 5 to the position shown at L2, assume unreally, for example, that the resultant line L2 passes through the point V′ a slight distance apart from the location V. By considering in the same manner the two triangles V′*a*′*b* and V′*c*′*d*, they are also similar and therefore $(X'+C)/X' = R1/R2$ (where $X'$ = distance between points V′ and *d*) . . . (2)

Comparing the formula (1) with formula (2), we have $(X+C)/X = (X'+C)/X' = R1/R2$ From the last formula, it is concluded that $1+C/X = 1+C/X'$. Hence $C/X = C/X'$, and $X = X'$, In other words, it is concluded that two points V and V′ are locationally identical, so that the line L2 also passes through the same vanishing point V rather than point V′.

By giving a considerable distance in design for both shoes 24 of the bracket 6, any fear that the bracket rattles on the ruler 5 when sliding thereon is alleviated. It will be understood that the ruler and the brackets 6 always slide to each other in the case where the levers 3 are swung for directing the ruler to a vanishing point.

What is claimed is;

1. An instrument for making perspective drawings comprising a base plate to be located on a drawing board, a slider, means mounting said slider on said base plate for rectilinear sliding movement thereon, means for clamping said slider to said base plate in any desired position therealong, a parallelogram lever-and-link arrangement comprising a pair of parallel levers pivotally mounted at one end thereof on said slider and a link extending between and pivotally connected to the opposite ends of said levers, a ruler, and a pair of joint structures respectively interconnecting said ruler with said levers, each said joint structure including a sleeve establishing a sliding fit on said lever together with means for releasably fastening them together, a bracket pivotally mounted on said sleeve, and shoe means carried by said bracket, said ruler being provided with a longitudinally extending slotted portion with which said shoe means are engaged for slidingly guiding longitudinal movement of said ruler, and means for clamping said shoe means to said slotted portion at any desired position along said ruler.

2. An instrument as defined in claim 1 for making perspective drawings wherein said means for mounting said slider on said base plate includes a longitudinally extending guide slot in said base plate and shoe means on said slider slidingly engaged within said guide slot, and wherein said means for clamping said slider to said base plate includes a clamping screw carried by said slider and engageable with the surface of said guide slot.

3. An instrument as defined in claim 2 for making perspective drawings wherein said guide slot in said base plate has an inverted T-shaped configuration and said clamping screw includes a bottom head, a stem uprising from said bottom head and a top head, said bottom head being nested within and slidably engaged with said guide slot, said stem being threaded and protruding outwardly and upwardly from said guide slot and through said slider, and said top head being a nut screwable onto said stem for clamping between it and said bottom head said slider and base plate.

* * * * *